US012686473B2

(12) United States Patent
Lewison et al.

(10) Patent No.: US 12,686,473 B2
(45) Date of Patent: Jul. 21, 2026

(54) CONVERTIBLE TOWABLE INFLATABLE DEVICE

(71) Applicant: Kwik Tek, Inc., Denver, CO (US)

(72) Inventors: Corey A. Lewison, Superior, CO (US); Kevin J. Kresch, Arvada, CO (US)

(73) Assignee: Kwik Tek, Inc., Denver, CO (US)

( * ) Notice: Subject to any disclaimer, the term of this patent is extended or adjusted under 35 U.S.C. 154(b) by 360 days.

(21) Appl. No.: 18/593,875

(22) Filed: Mar. 2, 2024

(65) Prior Publication Data

US 2025/0276768 A1 Sep. 4, 2025

(51) Int. Cl.
*B63B 34/54* (2020.01)
*B63B 34/52* (2020.01)

(52) U.S. Cl.
CPC ..... *B63B 34/54* (2020.02); *B63B 34/52* (2020.02)

(58) Field of Classification Search
CPC ..... B63B 34/50; B63B 34/54; B63B 34/52; B63C 2009/042; A47C 15/006; A47C 27/081
See application file for complete search history.

(56) References Cited

U.S. PATENT DOCUMENTS 3,740,095 A * 6/1973 Nail ..... B63B 34/52 441/130
5,964,628 A * 10/1999 Scanlon ..... A47C 15/006 114/354
7,104,852 B1 * 9/2006 Tsui ..... B63B 34/52 114/61.1
8,001,638 B1 * 8/2011 Quinter ..... A47D 15/001 5/722
8,782,833 B2 * 7/2014 Beurguet ..... A62B 31/00 5/628
10,357,112 B2 * 7/2019 Zheng ..... A47C 15/006
2006/0117487 A1 * 6/2006 Chen ..... A47C 15/006 5/951
2008/0207068 A1 * 8/2008 Rockstad ..... B63B 32/51 441/66
2015/0289663 A1 * 10/2015 Berenson ..... B63B 34/52 441/130

FOREIGN PATENT DOCUMENTS

KR 20100080265 A * 7/2010 ..... B63B 34/54

* cited by examiner

*Primary Examiner* — Andrew Polay
(74) *Attorney, Agent, or Firm* — Talus Law Group LLC

(57) ABSTRACT

Certain embodiments of the present invention provide an inflatable towable device for towing behind a watercraft providing accommodation for at least one rider and adapted to convert from a first configuration allowing a rider to safely ride the device in a seated position to a second configuration allowing a rider to safely ride the device in a prone lying position.

20 Claims, 17 Drawing Sheets

CONVERTIBLE TOWABLE INFLATABLE DEVICE

FIELD OF THE INVENTION

The present invention is directed to an inflatable device adapted for towing behind a watercraft providing multiple riding configurations, wherein the towable inflatable device accommodates at least one rider and is adapted to be converted from a first configuration allowing a rider to safely ride the device in a seated position to a second configuration allowing a rider to safely ride the device in a prone position.

BACKGROUND OF THE INVENTION

Towable inflatable devices for towing behind watercraft provide recreation in conjunction with motorized watercraft such as power boats and personal watercraft. The towable inflatable device accommodates at least one rider while another person pilots the watercraft to the enjoyment of the rider in the towable inflatable device and amusement of the person piloting the watercraft.

Given the significant forces imposed on towable inflatable devices and the need to be aerodynamic, they typically have no moving parts and are configured to safely accommodate a user in only a single position, i.e., seated or lying prone. A disadvantage of this reality is that the rider or riders cannot safely change positions on these towable inflatable devices and can become fatigued from remaining in a single riding position for any significant amount of time. Furthermore, even if the rider or riders do not become fatigued, they may become bored from being in the same position for the entire riding time. This fatigue or boredom can result in a rider using a towable inflatable device in a riding position for which it was not designed which can be unsecure and unsafe for the rider. For at least these reasons, there is a need for a towable inflatable device that provides multiple riding configurations, such as a seated and prone lying configuration.

SUMMARY OF THE INVENTION

It is a primary objective of the present invention to provide a towable inflatable device which is adapted to provide multiple comfortable and secure riding positions.

It is an aspect of the present invention to provide a configuration wherein a rider is in a secure seated position when on the towable inflatable device.

It is a further aspect of the present invention to provide an alternate configuration wherein a rider is in a secure prone lying position when on the towable inflatable device.

It is an aspect of the present invention to allow the towable inflatable device to be interchangeably converted from a seated configuration to a prone lying configuration and from a prone lying configuration to a seated configuration. Furthermore, it is an aspect of certain embodiments to maintain the hydrodynamic performance of the towable inflatable device when it is configured to a prone lying configuration.

It is an aspect of certain embodiments of the present invention to allow a first rider position to be configured independently of an adjacent rider position wherein a first rider position can be configured as a seated position or prone lying position, and a second rider position can be configured as a seated position or prone lying position independently of the first rider position.

It is an aspect of certain embodiments to provide lateral support on one or both sides of a rider. Furthermore, it is an aspect of certain embodiments to provide lateral support between each rider position wherein each rider position is interspaced with a lateral support.

It is an aspect of certain embodiments to provide a back rest which is configured to be placed in an upright orientation to provide a backrest for the seated configuration, and wherein the back rest is further configured to be lowered to a horizontal position to allow a user to lie horizontally upon the towable inflatable device preferably in a prone configuration.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 1B—A perspective view of certain embodiments of a towable inflatable device according to one embodiment of the present disclosure.

FIG. 2B—A perspective view of certain alternative embodiments of a towable inflatable device according to one embodiment of the present disclosure.

FIG. 3B—A top view of certain embodiments of a towable inflatable device according to one embodiment of the present disclosure.

FIG. 3C—A bottom view of certain embodiments of a towable inflatable device according to one embodiment of the present disclosure.

FIG. 3D—A rear view of certain embodiments of a towable inflatable device according to one embodiment of the present disclosure.

FIG. 4B—A side view of certain embodiments of a towable inflatable device according to one embodiment of the present disclosure.

FIG. 5B—A side view detail of certain embodiments of a towable inflatable device according to one embodiment of the present disclosure.

FIG. 5C—A side view detail of certain embodiments of a towable inflatable device according to one embodiment of the present disclosure.

FIG. 6B—A side view detail of certain alternative embodiments of a towable inflatable device according to one embodiment of the present disclosure.

FIG. 7B—A top view of certain embodiments of a towable inflatable device according to one embodiment of the present disclosure.

DETAILED DESCRIPTION OF VARIOUS EMBODIMENTS

Figure 1A:
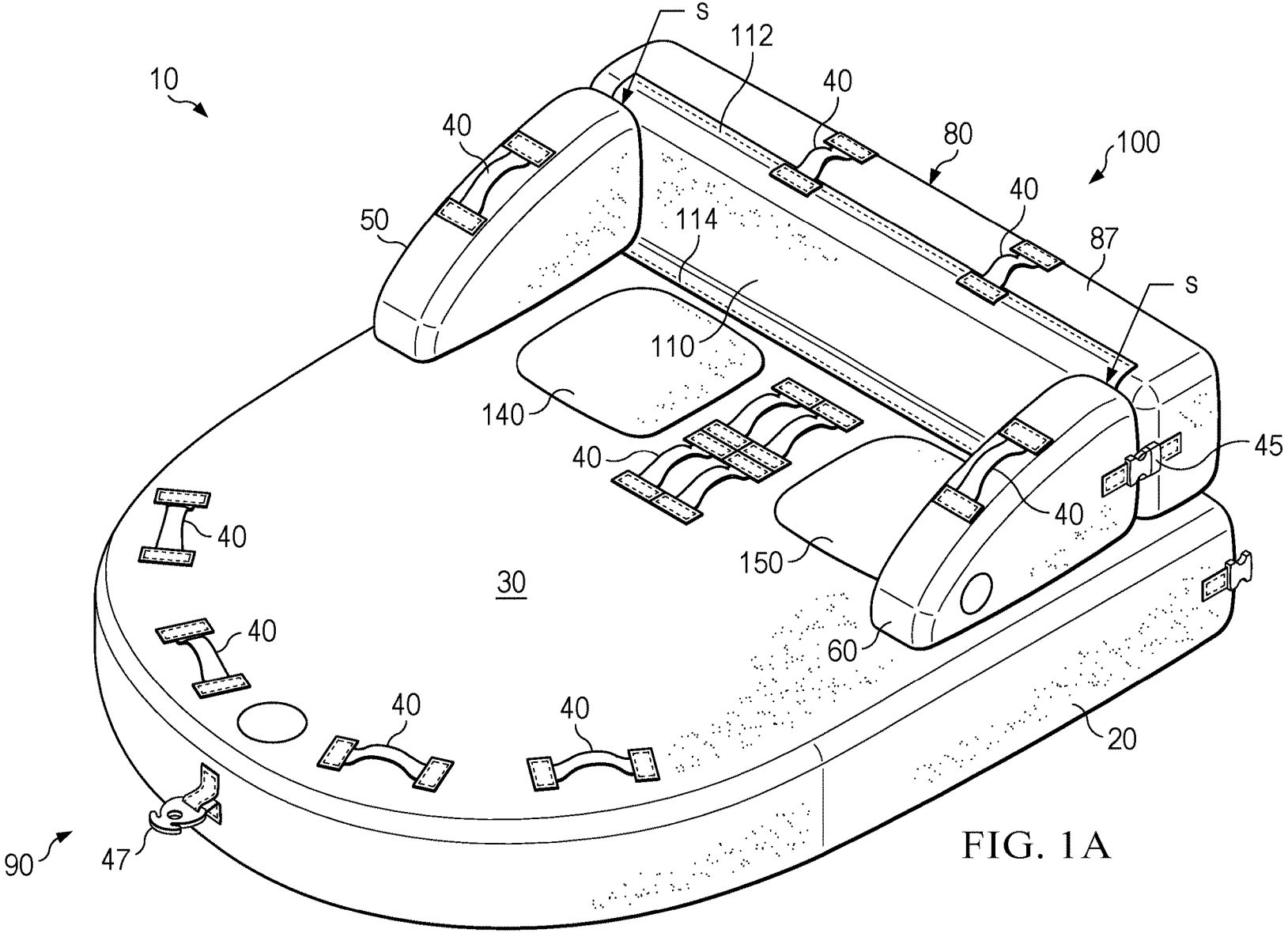
FIG. 1A—A perspective view of certain embodiments of a towable inflatable device according to one embodiment of the present disclosure.
Figure 1B:
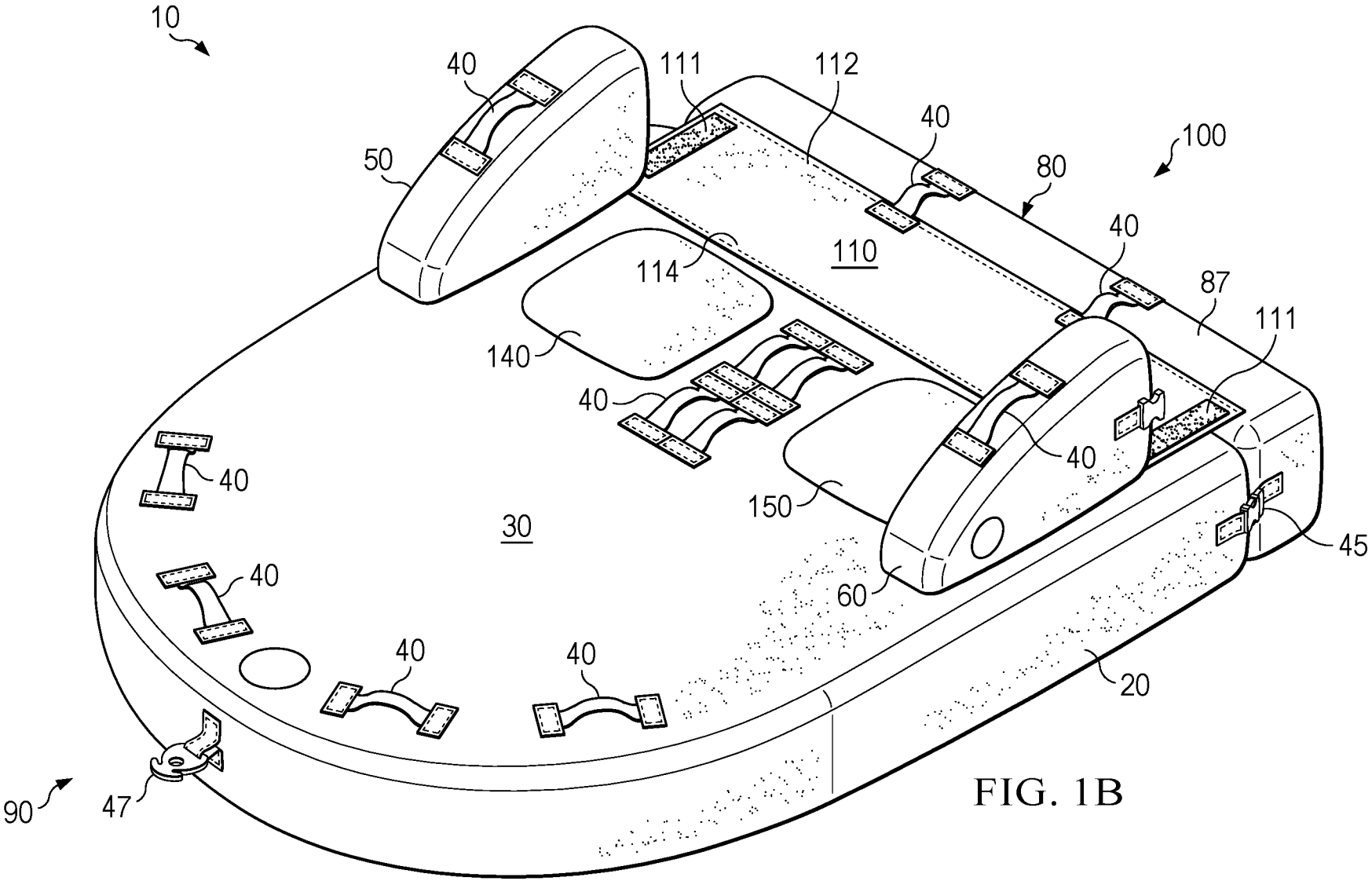

In certain embodiments of the present invention, as shown in FIGS. 1A-1B, a towable inflatable device 10 comprises an inflatable platform 20 adapted to allow a rider to ride thereon when the towable inflatable device is towed by a motorized watercraft. The top surface 30 of the platform comprises a plurality of handles 40 interconnected thereto. A tow attachment 47 is interconnected to a forwardmost position of the leading aspect 90 of the towable inflatable device 10. Tow attachment allows a tow rope from a watercraft to be tied to the towable inflatable device 10.

The towable inflatable device is configured to allow at least one rider to ride thereon. As shown in FIG. 1A, the towable inflatable device 10 comprises rider positions 140 and 150. The towable inflatable device further comprises a first lateral support 50 and a second lateral support 60 wherein the lateral supports are interconnected to the platform 20 at or in proximity to each of the lateral extents of the platform. The lateral supports 50/60 help to prevent a rider from sliding laterally off the platform 20.

Figure 2A:
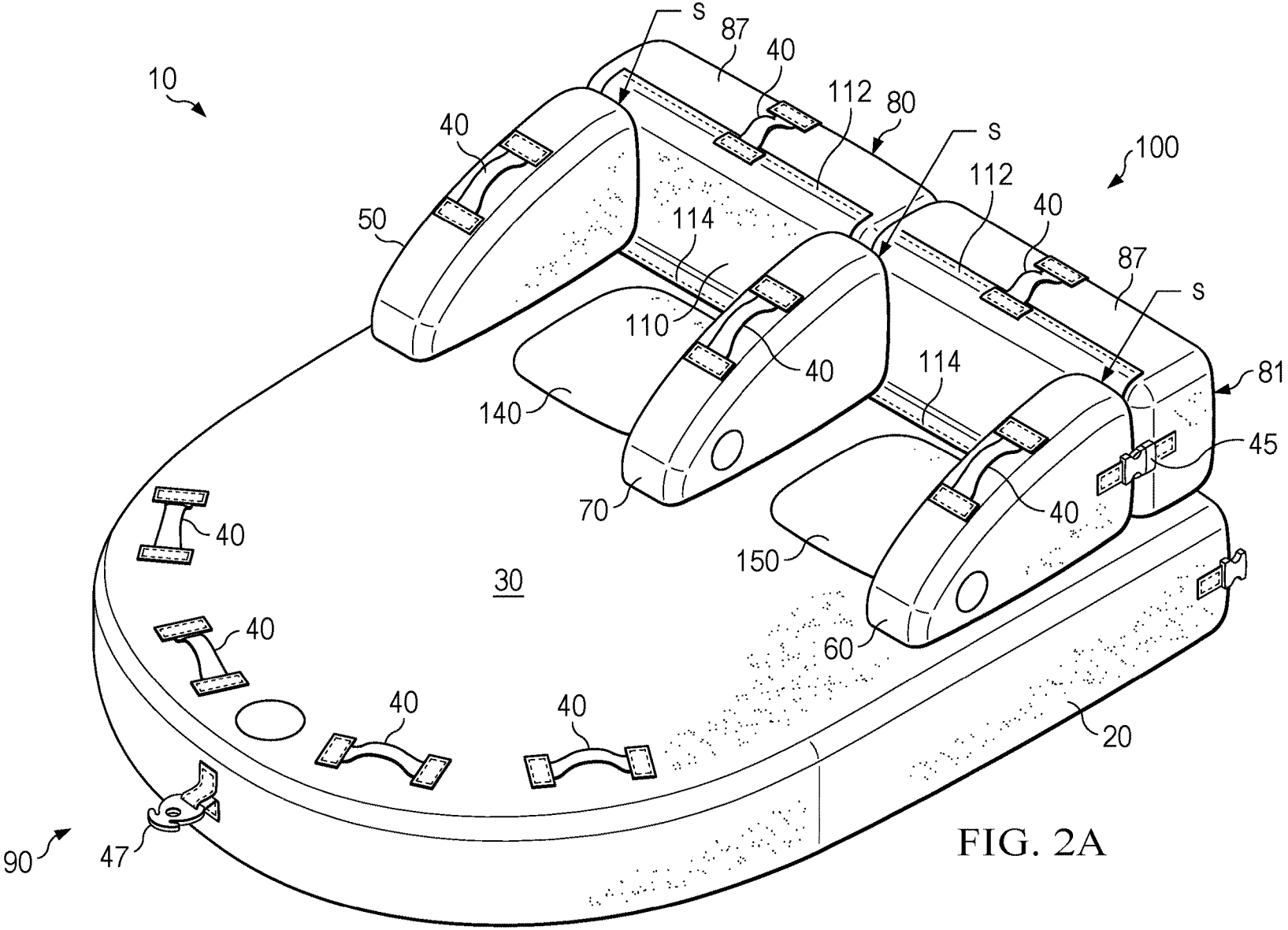
FIG. 2A—A perspective view of certain alternative embodiments of a towable inflatable device according to one embodiment of the present disclosure.
Figure 2B:
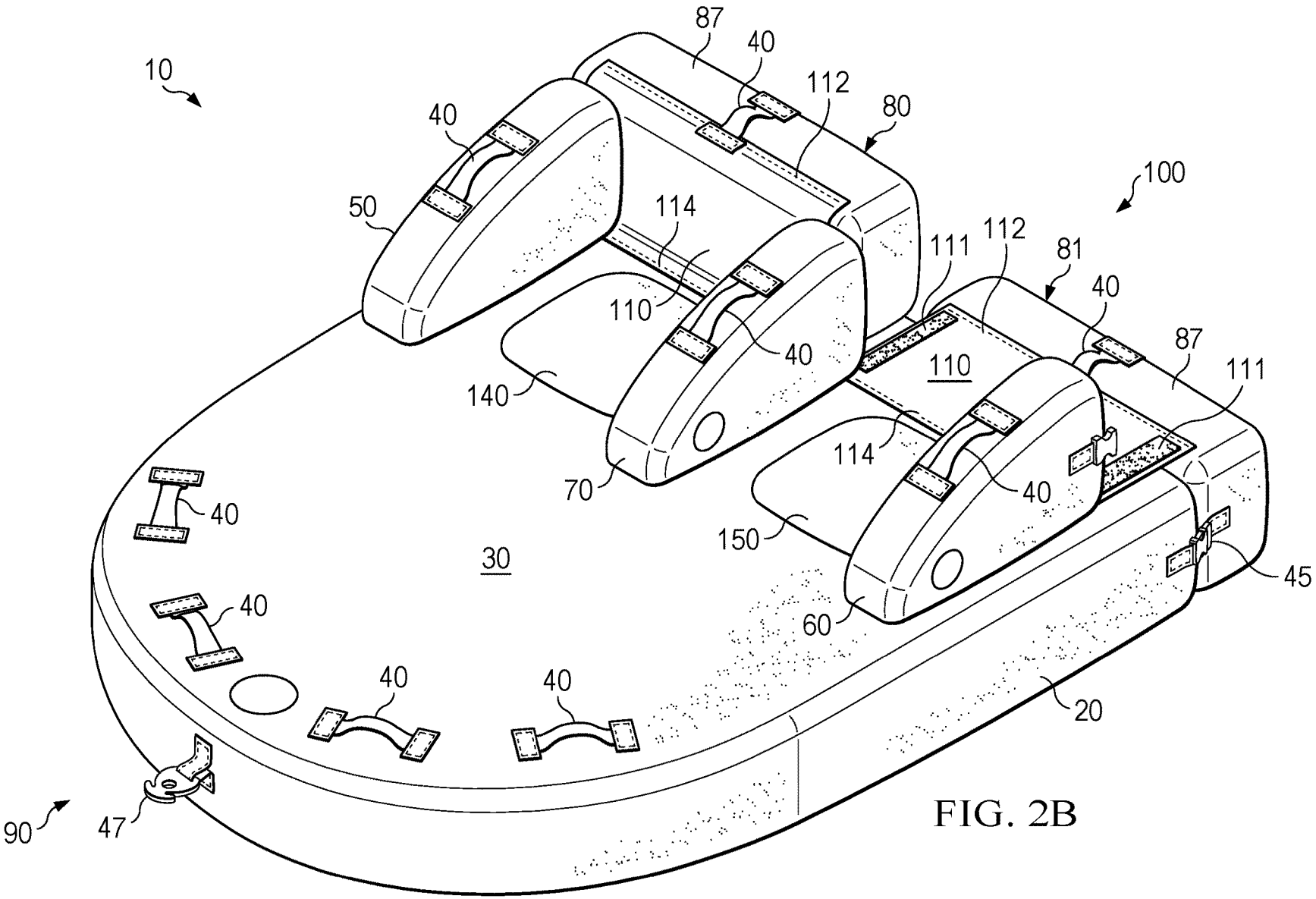

In certain embodiments, as shown in FIGS. 2A-2B, the towable inflatable device 10 comprises a middle lateral support 70 interconnected to the platform 20 between rider positions 140 and 150 to help prevent a rider from sliding laterally towards the rider in the other position. It will be appreciated that if the towable inflatable device 10 is configured for three or more riders that additional middle lateral supports may be provided between rider positions. Middle lateral supports may be utilized with the single backrest 80 shown in FIGS. 1A-1B. In the embodiment shown in in FIGS. 2A-2B, the backrest comprises backrest 80 and 81 which are separately interconnected to platform 20 and may be independently raised and lowered. This configuration allows the rider position 140 to be configured independently of rider position 150, for example, as shown in FIG. 2B with rider position 140 configured in a seated position and rider position 150 configured in a prone lying position. As shown in the figures, rider positions 140 and 150 may comprise an optional seat pad. However, the term "rider position" as used herein refers to the area on the towable inflatable device where the rider would sit or lie.

Figure 5A:
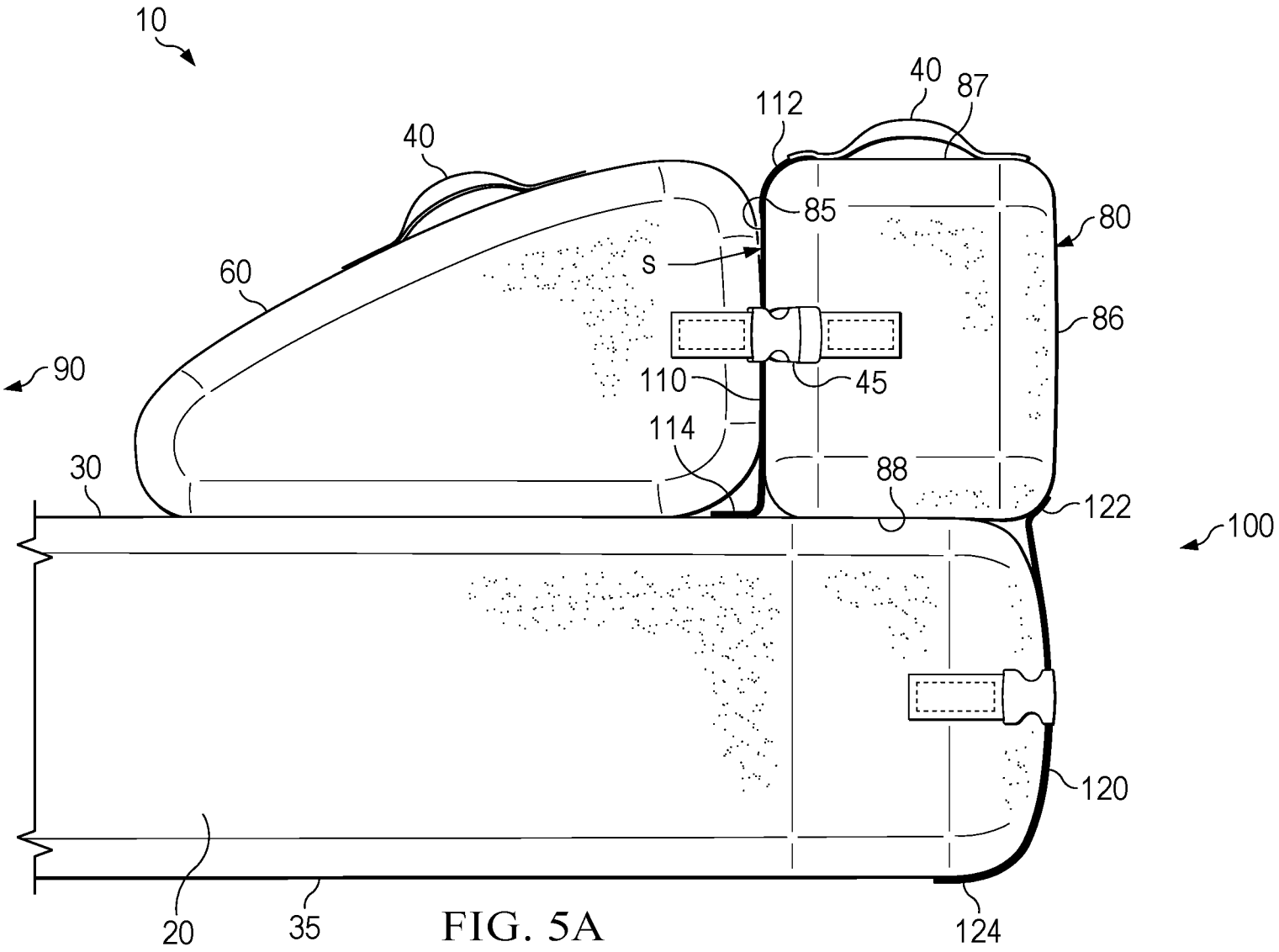
FIG. 5A—A side view detail of certain embodiments of a towable inflatable device according to one embodiment of the present disclosure.
Figure 5B:
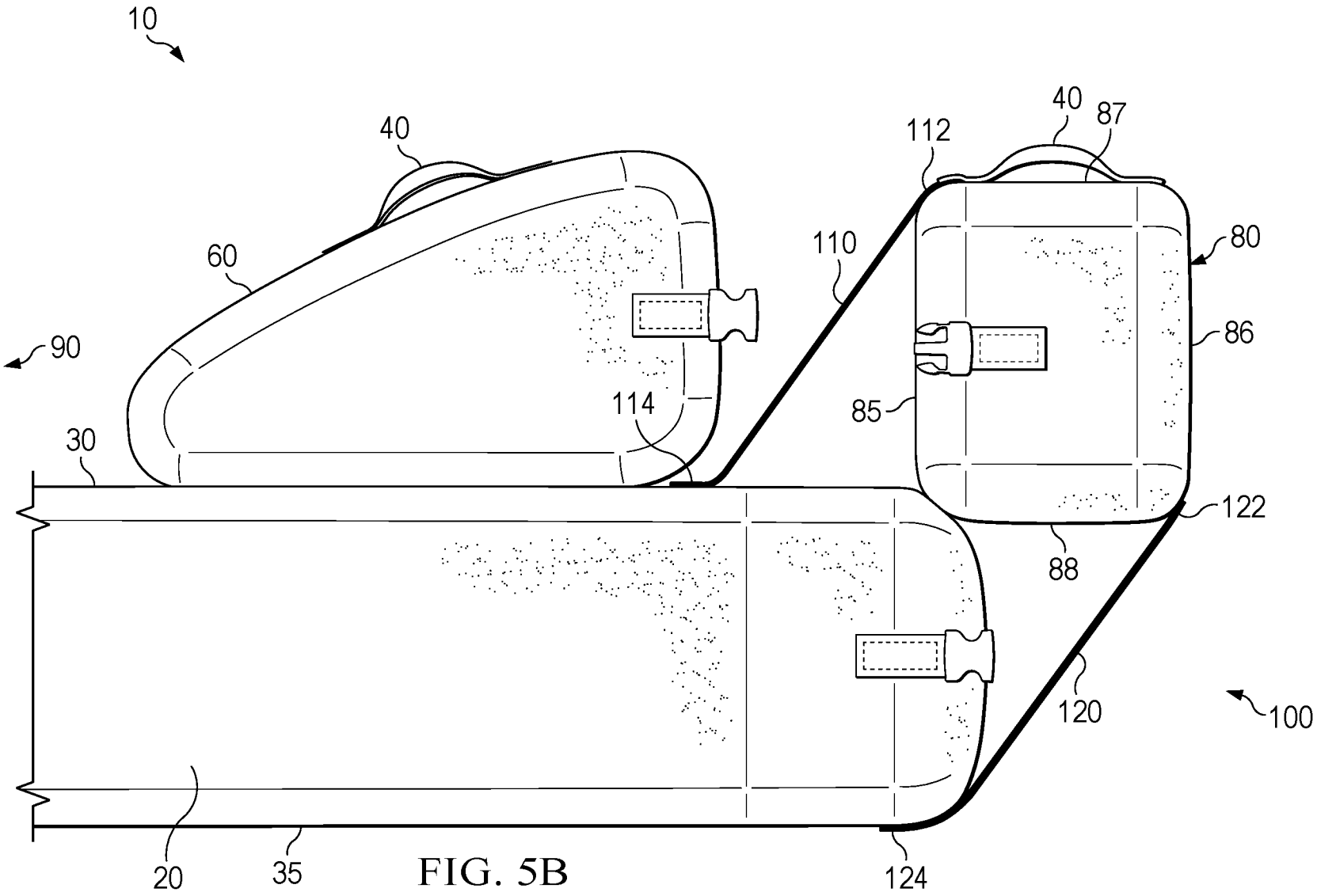
Figure 5C:
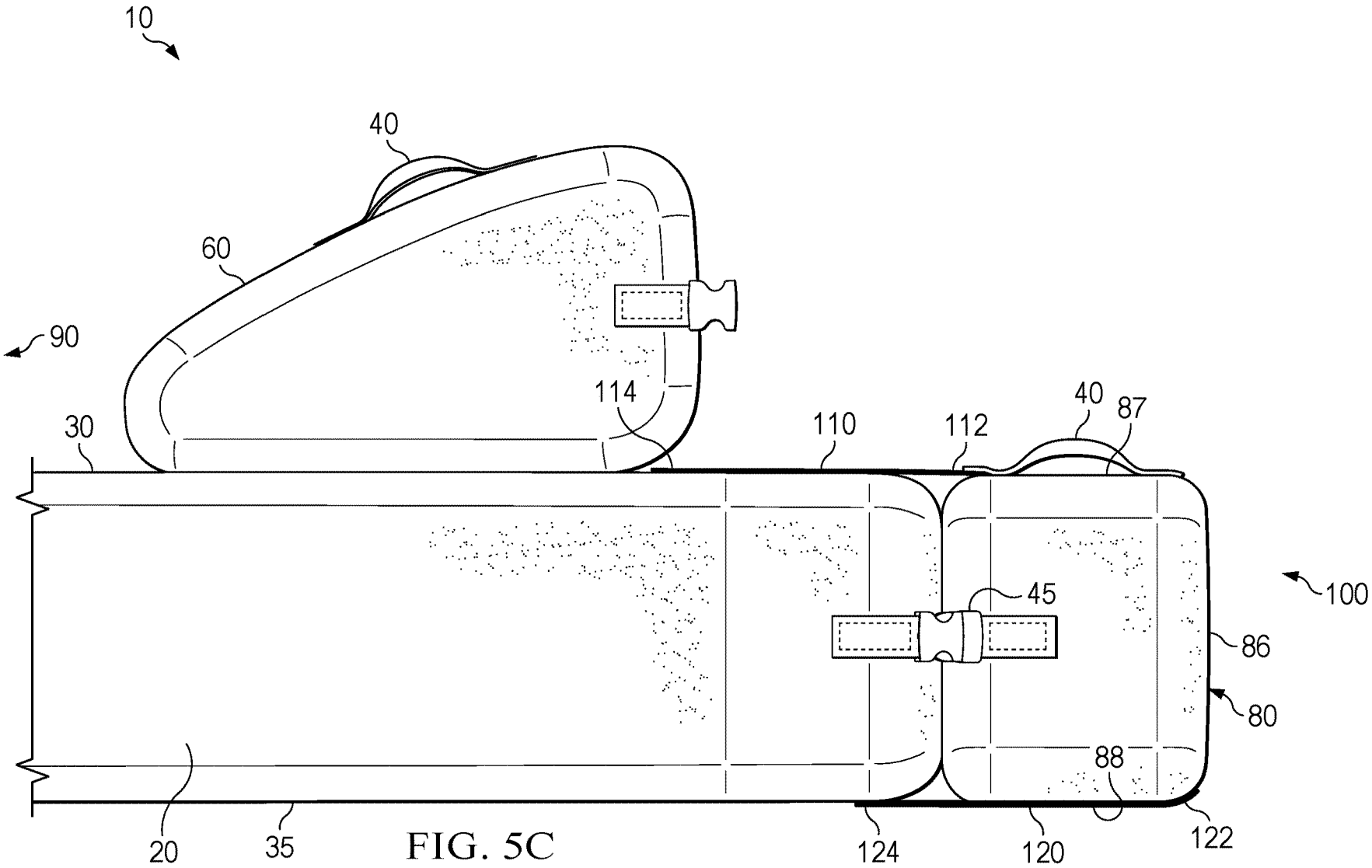

In certain embodiments, as shown in FIGS. 5A-5C, a towable inflatable device 10 further comprises a backrest 80 aligned with, or in near proximity to, the trailing aspect 100 of the platform. The backrest 80 spans across lateral supports 50/60 and the backrest front surface 85 abuts the rear aspects of lateral supports 50/60. In a seated configuration, the bottom surface 88 of the backrest 80 rests on the top surface 30 of the platform, and backrest front surface 85 of the backrest is oriented in an upright orientation in relation to the top surface 30 and faces the forward or leading aspect 90 of the towable inflatable device 10, wherein a seated user can rest their back against the backrest front surface 85. In a prone configuration, the backrest front surface 85 of the backrest 80 is declined such that the backrest front surface 85 contacts the rear or trailing edge surface 100 of the platform, thereby creating a contiguous and substantially flat surface comprising the top surface of the platform 30 and the top surface 87 of the backrest wherein a user can lay prone. As shown in FIG. 5C, in a preferred embodiment, the distance between the top surface 87 and bottom surface 88 of the backrest is about equal to the distance between the top surface 30 and bottom surface 35 of the platform such that these top and bottom surfaces are contiguous or near-contiguous when the backrest is in a lowered position. As shown in FIG. 5A, in a preferred embodiment, the lateral supports (lateral support 60 shown) are set forward a distance from trailing aspect 100 that is about equal to the distance between the backrest front surface 85 and the backrest rear surface 86.

Figure 3A:
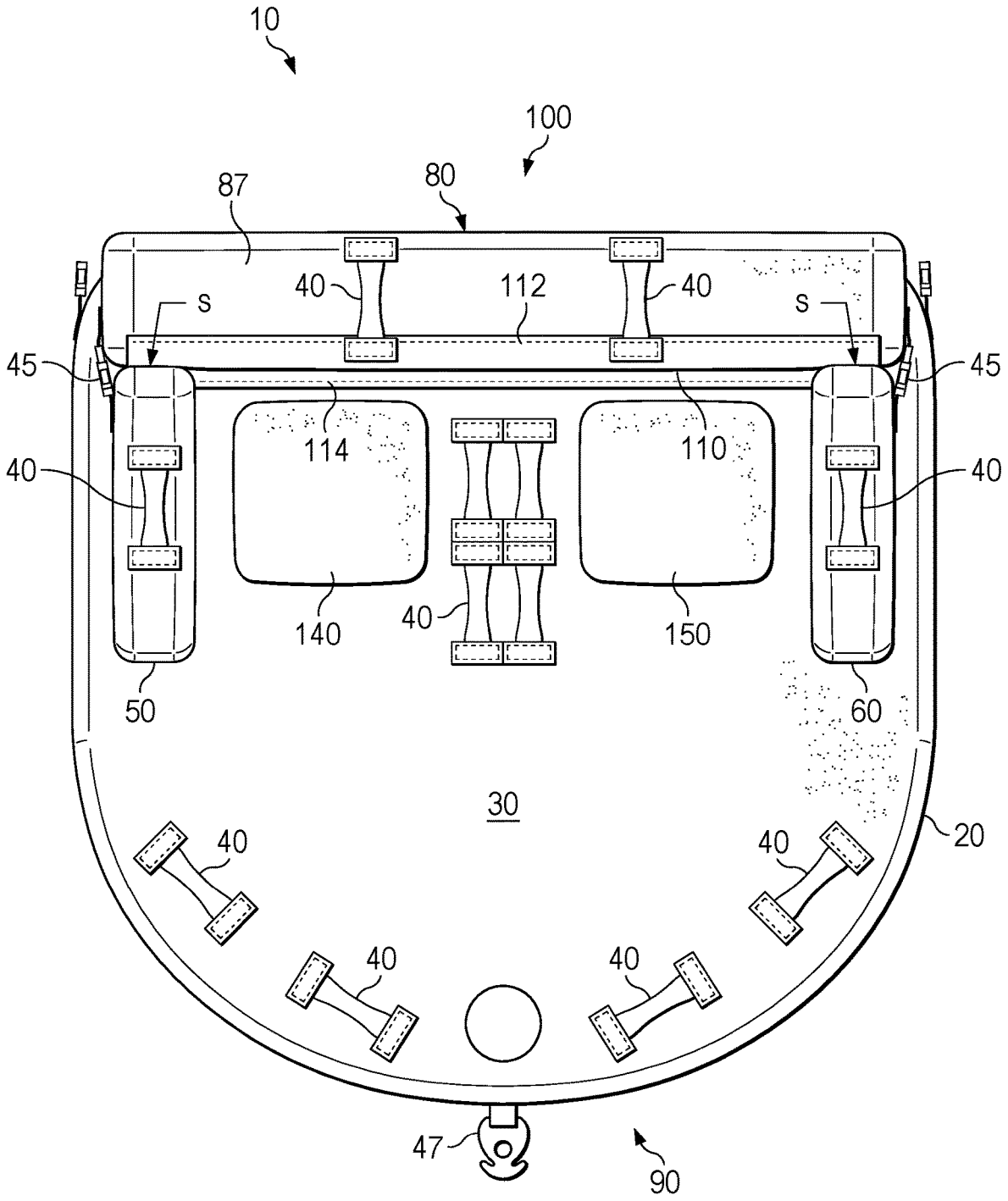
FIG. 3A—A top view of certain embodiments of a towable inflatable device according to one embodiment of the present disclosure.
Figure 3B:
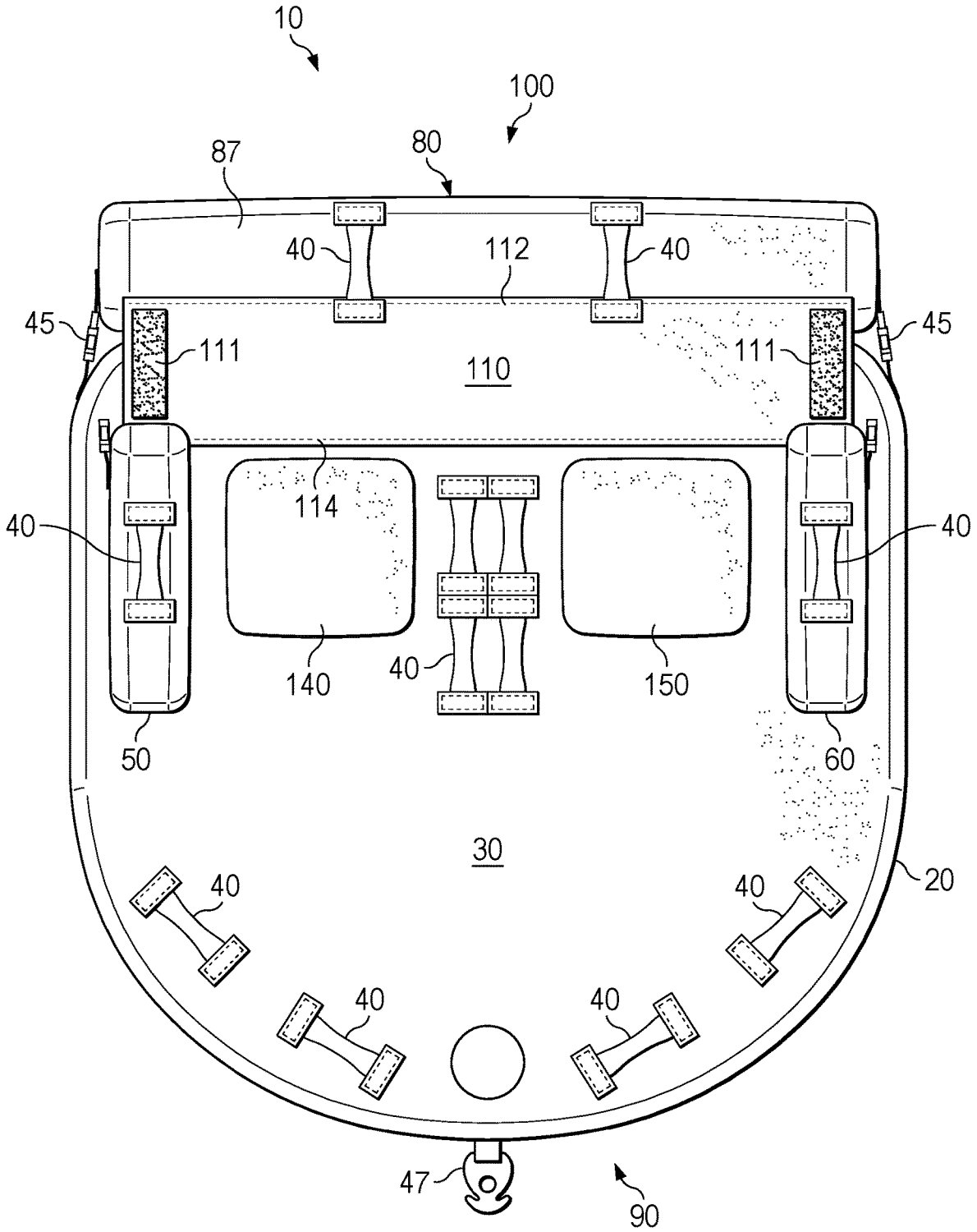
Figure 3C:
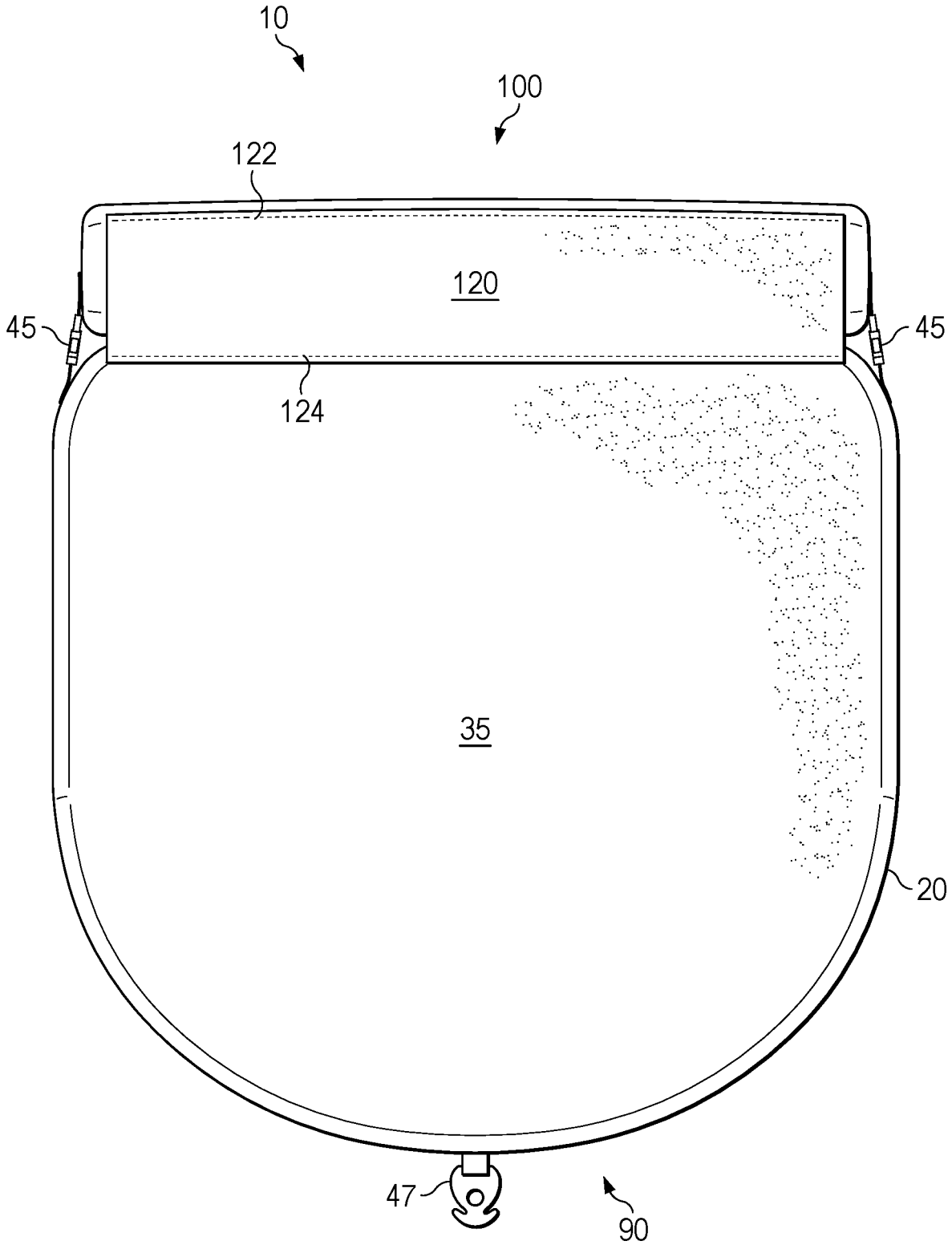
Figure 3D:
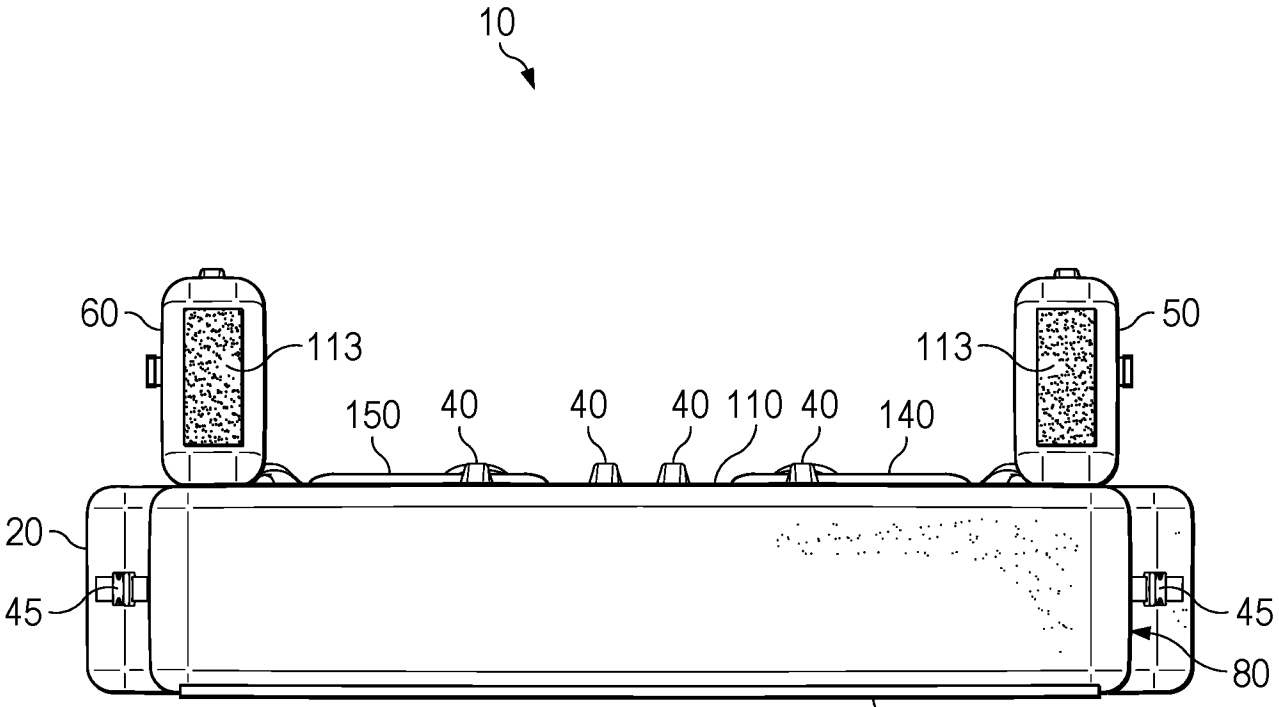
Figure 4A:
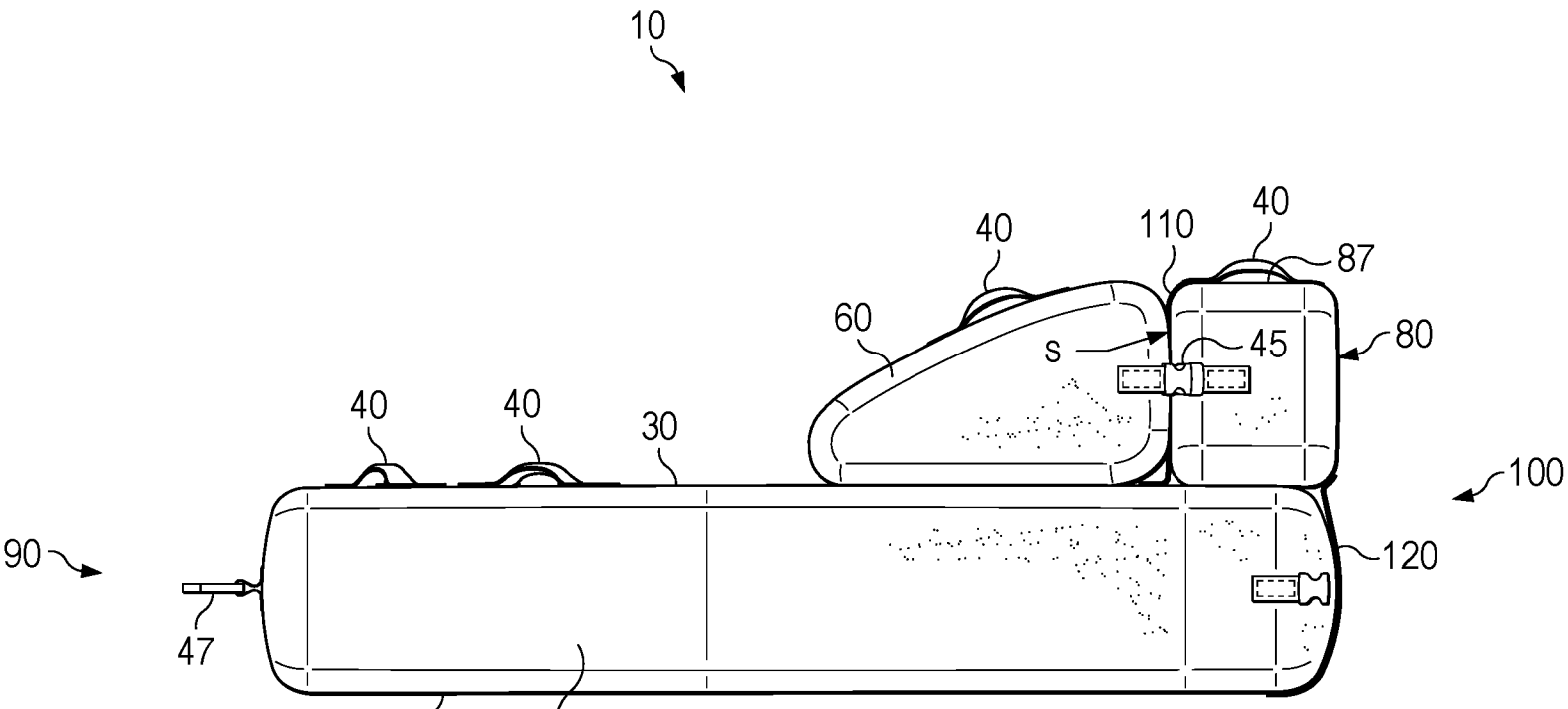
FIG. 4A—A side view of certain embodiments of a towable inflatable device according to one embodiment of the present disclosure.
Figure 4B:
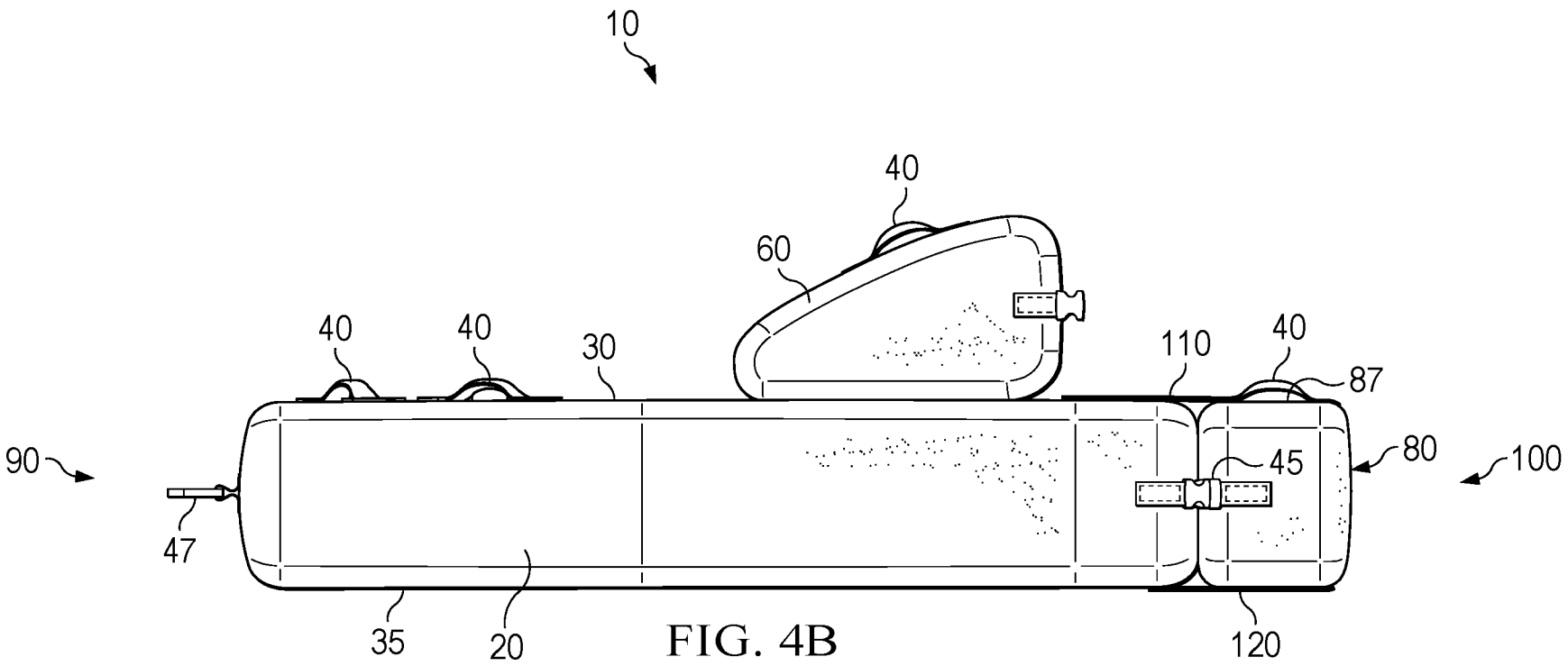

As shown in FIGS. 3A-3D and the side views of FIGS. 5A-5C, in certain embodiments the backrest 80 is moveably interconnected to the platform by an elongated first flexible hinge panel 110 and an elongated second flexible hinge panel 120. In certain embodiments, the first and second flexible hinge panels 110 and 120 comprise a fabric material. In other embodiments, the first and/or second flexible hinge panels 110 and 120 may comprise other flexible materials such as webbing, hook and loop material, i.e., Velcro, or mesh. The first edge 112 of the first flexible hinge panel 110 is interconnected to the top surface 87 of the backrest 80 toward the leading or forward aspect 90 of the towable inflatable device and the second opposing edge 114 of the first flexible hinge panel is interconnected to the top surface 30 of the platform 20 at a distance from the rear or trailing edge surface of the platform that is about equal to the distance from the rear surface to the backrest surface of the backrest. In a preferred embodiment, the first edge 122 of the second flexible hinge panel is interconnected to the backrest proximate to the corner formed where the bottom and back surfaces of the backrest meet, and the second opposing edge 124 of the second flexible hinge panel is interconnected to the bottom surface of the platform 20 proximate to the corner formed by the bottom surface and trailing edge. The first and second flexible hinge panels 110/120 are preferably taut when the backrest 80 is in the upper seating position, as shown in FIG. 5A, and the lowered prone lying position, as shown in FIG. 5C. As will be appreciated, the interconnection locations for the edges of the second flexible hinge panel to the backrest and platform may be moved in either direction along the surfaces shown if FIGS. 5A-5C, i.e., toward or away from the corners, so long as the interconnections allow for the second flexible hinge panel to remain taut in both upper and lowered positions. In the upper seating position, these taut panels make the backrest more comfortable for the rider and pull the bottom surface 88 of the backrest towards the top surface 30 of the platform to increase the frictional interconnection in the upper position. In turn, in the lowered prone position, the taut panels pull the backrest front surface 85 towards the rear edge of the platform to increase the frictional interconnection between the backrest and platform 20 when the backrest in the lowered position. As a result, the first and second flexible hinge panels 110/120 ensure a contiguous and substantially flat top surface upon which the rider can lay prone, and a substantially flat and hydrodynamically efficient surface on the lower surface of the towable inflatable device. Embodiments wherein the first and/or second flexible hinge panels comprise a plurality of interspaced panels or straps are within the spirit and scope of the present invention. However, as shown in FIGS. 1A, 1B, and 3A-3C, in a preferred embodiment, the first flexible hinge panel 110 spans substantially across the gap between the platform and backrest to help prevent a rider's arms and legs from slipping therebetween in either the seated or prone positions. As shown in FIG. 3C, the second flexible hinge 120 spans substantially across the gap between the platform and backrest to increase the hydrodynamically efficient surface on the lower surface of the towable inflatable device.

Further, as indicated at S in FIGS. 1A-2B and 3D, the ends of flexible hinge panel 110 are sandwiched between backrest 80/81 and the lateral supports 50/60/70. Hook and loop patches 111 at the ends of first flexible hinge panel 110 interconnect to corresponding hook and loop patches 113 at the rearward ends of the lateral supports. These interconnecting patches hook and loop patches 111/113 help to prevent a rider's arms and legs from slipping between the backrest 80/81 and lateral supports 50/60/70 in the seated position.

Figure 6A:
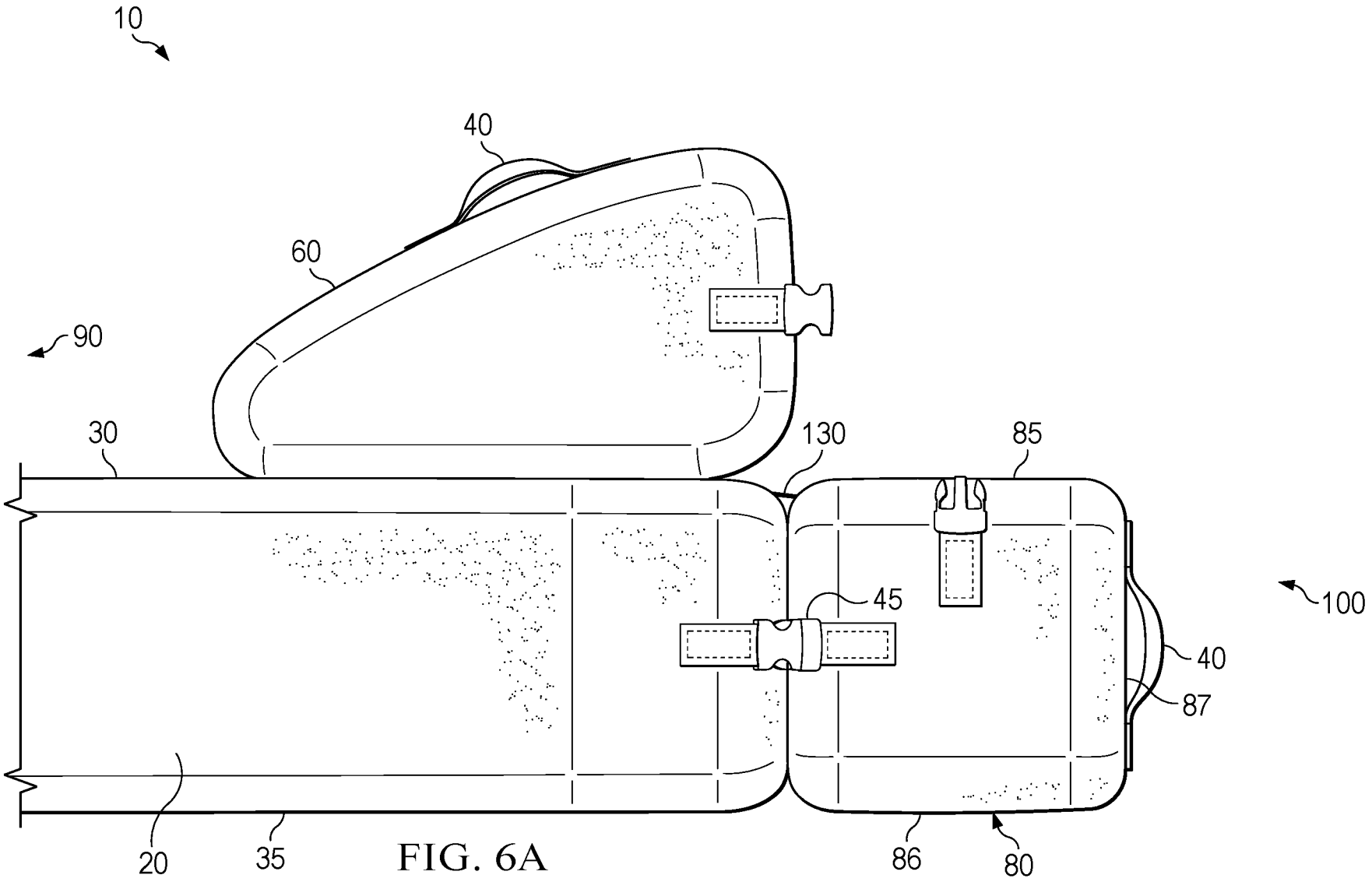
FIG. 6A—A side view detail of certain alternative embodiments of a towable inflatable device according to one embodiment of the present disclosure.
Figure 6B:
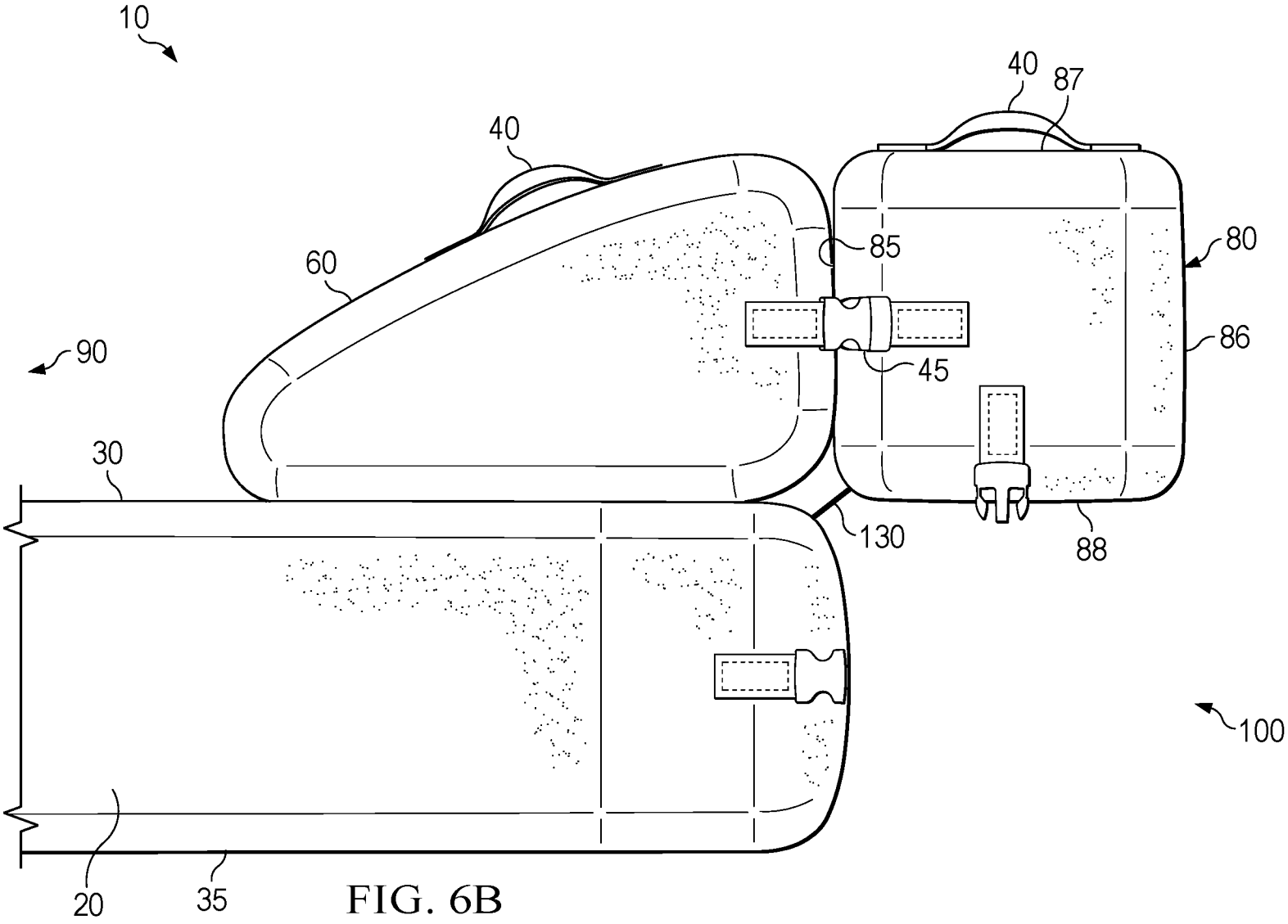

In other embodiments, as shown in FIGS. 6A-6B, the backrest 80 is hingedly interconnected to the top corner of the rear or trailing edge of the platform. The hinged interconnection 130 may comprise a sewn seam, a living hinge, or a flexible panel or strip made of fabric or other suitable flexible material. In these embodiments it is desirable for the backrest front surface 85 of the backrest to be substantially parallel with the top surface 30 of the platform when the backrest is lowered to the prone configuration. However, embodiments for the prone configuration of the backrest are not limited thereto. In certain embodiments, the living hinge comprises a unitary piece of material extending from the first lateral aspect of the platform 20 to the backrest 80. Embodiments wherein the living hinge comprises a plurality of living hinges interspaced along the trailing aspect of the platform are within the spirit and scope of the present invention. In certain embodiments the living hinge removably interconnects the backrest to the platform such as with hook and loop fasteners, button snaps, or other removable interconnection devices known in the art.

In certain embodiments, the top surface 30 of the platform comprises a hook and loop fastener interconnected to the trailing aspect of the platform, and extending substantially from the first lateral support 50 to the second lateral support 60. The backrest 80 also comprises a hook and loop fastener along a bottom leading edge. Thus, the interconnection of the living hinge to each of the backrest and the platform interconnects the backrest to the platform wherein the backrest can be alternately placed in a seated configuration, and a prone configuration.

Figure 7A:
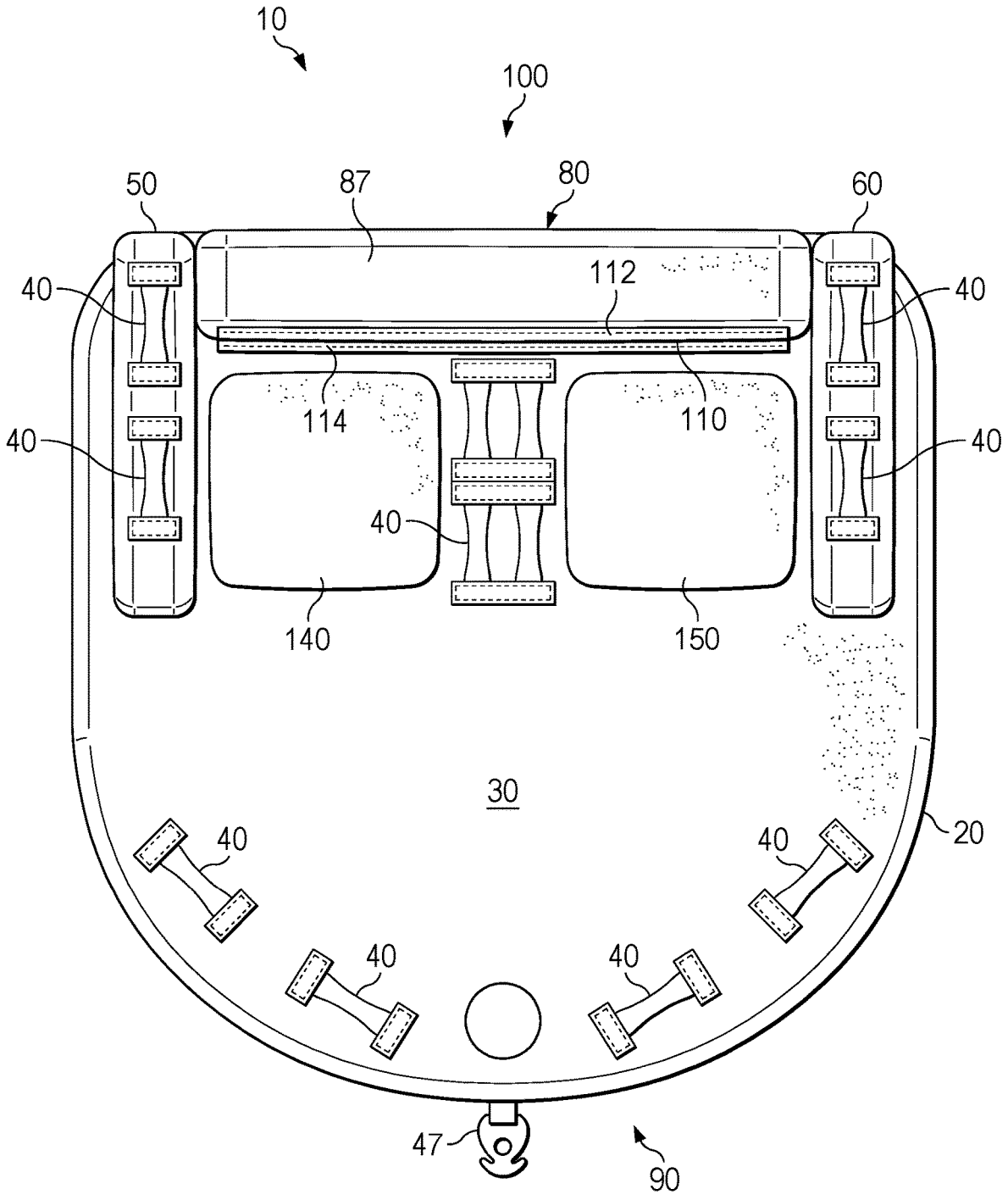
FIG. 7A—A top view of certain embodiments of a towable inflatable device according to one embodiment of the present disclosure.
Figure 7B:
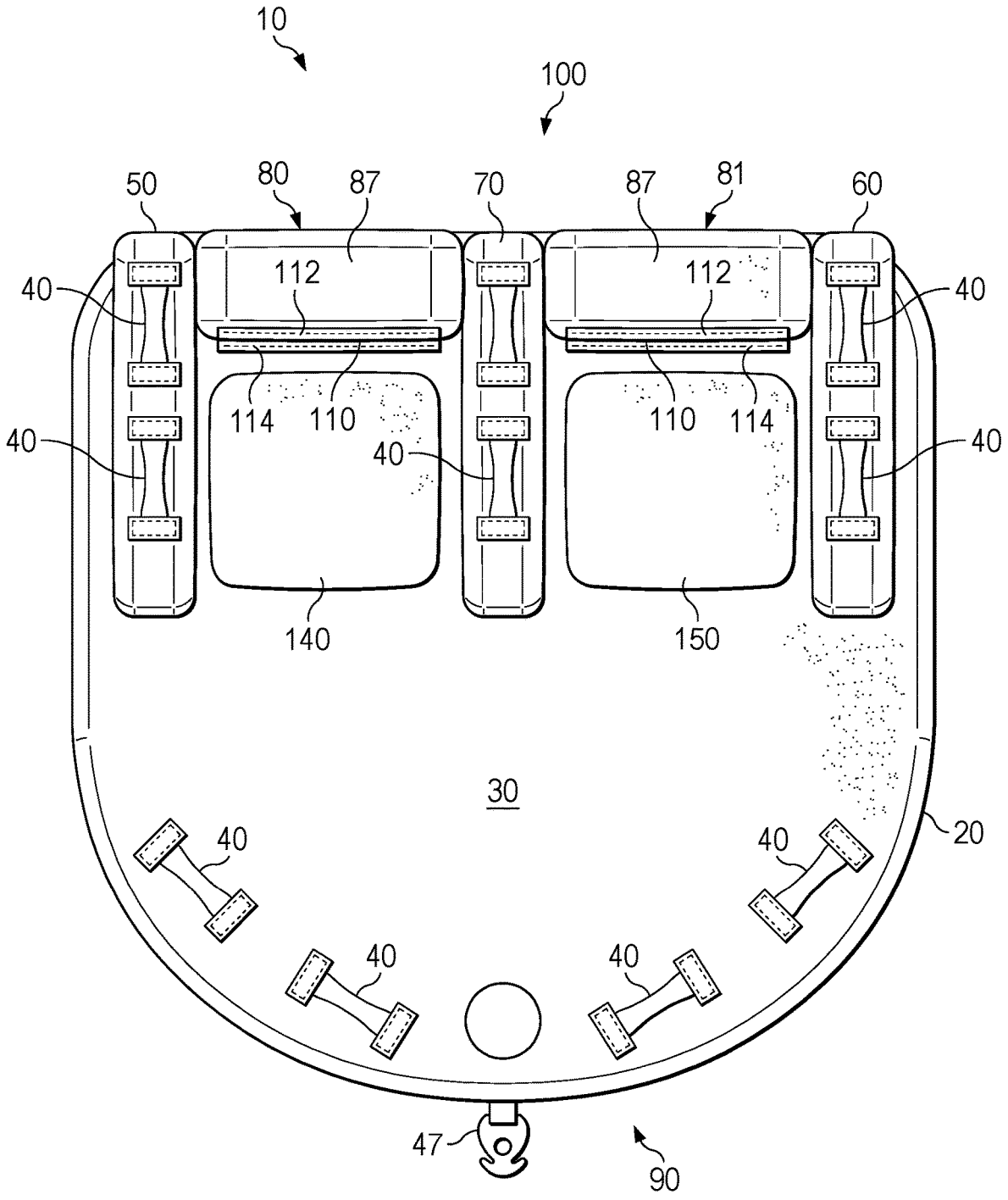

In certain embodiments, as shown in FIG. 7A, the backrest 80 comprises an inflatable panel configured to extend between first lateral support 50 and second lateral support 60, wherein when backrest 80 is in an upright configuration, backrest 80 is disposed between and abuts the inboard lateral surfaces of each of the lateral supports 50/60. In certain alternative embodiments, as shown in FIG. 7B, the seating positions 140 and 150 are separated by third lateral support 70. Backrests 80 and 81 are disposed between and abut the inboard lateral surfaces of each of the lateral supports 50/60/70 and independently interconnected to platform 20 by first flexible hinge panels 110 and 120 (not shown), which comprise two pieces to accommodate third lateral support 70 and to allow backrests 80 and 81 to be independently raised and lowered. This configuration allows the rider position 140 to be configured independently of rider position 150, for example, as shown in FIG. 7B with rider position 140 configured in a seated position and rider position 150 configured in a prone lying position. As shown in FIGS. 7A and 7B, in embodiments where the backrest 80 and/or 81 is disposed inside the lateral supports, it is preferable that the rearward aspects of the lateral supports are substantially aligned with the trailing aspect 100 of the platform 20.

In use, a seated configuration allows a user to sit in a seated position with their back against the back surface 85 of the backrest 80, and grab hold of one or more of a plurality of handles 40 interconnected to the towable inflatable device 10. Handles 40 of certain embodiments can be interconnected to the top surface 30 of the platform, to a top surface of the lateral supports 50, 60 and 70, to the top surface 87 of the backrest 80, or to the rear surface 86 of the backrest 80. Alternatively, in a seated configuration a user is able to kneel on the platform 20 and face rearward wherein the user is able to hold onto handles interconnected to the top surface 87 of the backrest 80, the backrest surface 85 of the backrest 80, or the top surface of the lateral supports 50/60/70. The prone configuration allows a user to lay prone, preferably with their head in the direction of travel. Handles 40 interconnected to the top surface 30 in proximity to the leading aspect 90 of the platform 20 allow users to hold on while lying in a prone position.

Certain embodiments of the present invention comprise two lateral supports interconnected to the top surface of the platform in proximity to the lateral aspects of the platform, and (n) lateral supports located between the two lateral supports resulting in (2+n) lateral supports. In certain embodiments a single backrest spans from the first lateral aspect of the platform to the second lateral aspect of the platform, wherein the backrest abuts the rear surfaces of the lateral supports. Alternatively, in certain embodiments a plurality (1+n) backrests, wherein the backrests are configured to nest between the lateral supports wherein the lateral surfaces of the backrests abut lateral surfaces of the lateral supports. Furthermore, embodiments comprising (2+n) lateral supports which comprise less than (1+n) backrests, wherein the backrest surface of the backrest abuts the rear surfaces of a plurality of lateral supports, are within the spirit and scope of the present invention. Further still, embodiments comprising (2+n) lateral supports which comprise a singular backrest, wherein the backrest surface of the backrest abuts the rear surfaces of a plurality of lateral supports are within the spirit and scope of the present invention.

The towable inflatable device 10 may be constructed of components comprising a fabric outer layer forming a chamber for an inflatable bladder. For example, the platform, lateral supports, and back rest(s) may each comprise fabric pieces suitably sized and shaped that are either sewn or welded together to form the necessary shape of the component and are adapted to contain an inflatable bladder that is preferably the same general shape as the component. Access to the chamber may be provided through a zippered or hook and loop, i.e., Velcro, opening. The individual components may be interconnected together by sewn seams, welded seams, zippers, fabric panels, hook and loop, and/or straps to form the overall shape of the towable inflatable device.

In certain embodiments of the present invention, a backrest is constrained to a seated configuration with fasteners 45 which extend from the backrest to the lateral supports when the backrest is in an upper seated position, and which extend from the backrest to the platform when the backrest is in a lowered prone position. In certain embodiments the fasteners are interconnected to the backrest surface of the backrest, while other embodiments comprise fasteners which interconnect to the lateral surfaces or ends of the backrests. Further still, certain embodiments comprise fasteners which are interconnected to a rear surface of the backrest, wherein the rear surface of the backrest is configured to face rearward when the backrest is in a seated configuration. The fasteners 45 of various embodiments can be selected from hook and loop, tethers intended for tying knots, magnets, cinching elements such as cam straps, snap buckles, and other known fastenings methods while in keeping with the spirit and scope of the present invention. In order to constrain the backrest in a seated configuration, it may be desired to interconnect the backrest to lateral supports, to the platform, or to both the lateral supports and the platform.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A towable inflatable device for at least one rider comprising:

an inflatable platform comprising a top surface and a trailing aspect;

a first lateral support comprising a rear aspect, the first lateral support interconnected to a first lateral aspect of the top surface of the platform;

a second lateral support comprising a rear aspect, the second lateral support interconnected to a second lateral aspect of the top surface of the platform; and a backrest comprising a front surface, a bottom surface, and a top surface;

wherein the backrest is interconnected to the trailing aspect of the platform and is adapted to move from a first position to a second position;

wherein, when the backrest is in the first position, the bottom surface of the backrest rests on the top surface of the platform and the front surface of the backrest abuts the rear aspects of the first and second lateral supports; and wherein, when the backrest is in the second position, the backrest and the top surface of the platform form a surface upon which the at least one rider can lay prone.

2. The towable inflatable device of claim 1 further comprising a first flexible hinge panel comprising a first edge and a second edge, wherein the first edge of the first flexible hinge panel is interconnected to the top surface of the backrest and the second edge of the first flexible hinge panel is interconnected to the top surface of the platform.

3. The towable inflatable device of claim 2 further comprising a second flexible hinge panel comprising a first edge and a second edge, wherein the first edge of the second flexible hinge panel is interconnected to the backrest and the second edge of the second flexible hinge panel is interconnected to the bottom surface of the platform.

4. The towable inflatable device of claim 3 further comprising at least two rider positions.

5. The towable inflatable device of claim 4 further comprising a third lateral support interconnected to the top surface of the platform between the two rider positions.

6. The towable inflatable device of claim 5 wherein the backrest comprises a first portion and a second portion, wherein the first portion of the backrest is adapted to move from the first position to the second position independently from the second portion.

7. The towable inflatable device of claim 2 wherein the first flexible hinge panel comprises a first end and a second end and wherein, when the backrest is in the first position, the first end of the first flexible hinge panel is sandwiched between the front surface of the backrest and the rear aspect of the first lateral support and the second end of the first flexible hinge panel is sandwiched between the front surface of the backrest and the rear aspect of the second lateral support.

8. The towable inflatable device of claim 7 wherein, when the backrest is in the first position, the first end of the first flexible hinge panel is interconnected to the rear aspect of the first lateral support by a hook and loop patch and the second end of the first flexible hinge panel is interconnected to the rear aspect of the second lateral support by a hook and loop patch.

9. The towable inflatable device of claim 6 wherein the first flexible hinge panel comprises a first portion and a second portion, wherein when the first portion of the backrest is in the first position, a first end of the first portion of the first flexible hinge panel is sandwiched between the front surface of the first portion of the backrest and the rear aspect of the first lateral support and a second end of the first portion of the first flexible hinge panel is sandwiched between the front surface of the first portion of the backrest and the rear aspect of the third lateral support.

10. The towable inflatable device of claim 9 wherein, when the second portion of the backrest is in the first position, a first end of the second portion of the first flexible hinge panel is sandwiched between the front surface of the second portion of the backrest and the rear aspect of the second lateral support and a second end of the second portion of the first flexible hinge panel is sandwiched between the front surface of the second portion of the backrest and the rear aspect of the third lateral support.

11. A towable inflatable device for at least one rider comprising:

an inflatable platform comprising a top surface, a bottom surface, and a trailing aspect;

a first lateral support comprising a rear aspect, the first lateral support interconnected to a first lateral aspect of the top surface of the platform;

a second lateral support comprising a rear aspect, the second lateral support interconnected to a second lateral aspect of the top surface of the platform; and a backrest comprising a front surface, a rear surface, a bottom surface, and a top surface;

wherein the backrest is moveably interconnected to the platform and adapted to move from a first position to a second position;

wherein, when the backrest is in the first position, the bottom surface of the backrest abuts the top surface of the platform and the front surface of the backrest abuts the rear aspects of the first and second lateral supports; and wherein, when the backrest is in the second position, at least one of the front, rear, or bottom surfaces of the backrest abuts the trailing aspect of the platform.

12. The towable inflatable device of claim 11 further comprising a first flexible hinge panel comprising a first edge and a second edge, wherein the first edge of the first flexible hinge panel is interconnected to the backrest and the second edge of the first flexible hinge panel is interconnected to the top surface of the platform.

13. The towable inflatable device of claim 12 further comprising a second flexible hinge panel comprising a first edge and a second edge, wherein the first edge of the second flexible hinge panel is interconnected to the backrest and the second edge of the second flexible hinge panel is interconnected to the bottom surface of the platform.

14. The towable inflatable device of claim 13 further comprising at least two rider positions.

15. The towable inflatable device of claim 14 further comprising a third lateral support interconnected to the top surface of the platform between the two rider positions.

16. The towable inflatable device of claim 15 wherein the backrest comprises a first portion and a second portion, wherein the first portion of the backrest is adapted to move from the first position to the second position independently from the second portion.

17. The towable inflatable device of claim 12 wherein the first flexible hinge panel comprises a first end and a second end and wherein, when the backrest is in the first position, the first end of the first flexible hinge panel is sandwiched between the front surface of the backrest and the rear aspect of the first lateral support and the second end of the first flexible hinge panel is sandwiched between the front surface of the backrest and the rear aspect of the second lateral support.

18. The towable inflatable device of claim 17 wherein, when the backrest is in the first position, the first end of the first flexible hinge panel is interconnected to the rear aspect of the first lateral support by a hook and loop patch and the second end of the first flexible hinge panel is interconnected to the rear aspect of the second lateral support by a hook and loop patch.

19. The towable inflatable device of claim 16 wherein the first flexible hinge panel comprises a first portion and a second portion, wherein when the first portion of the backrest is in the first position, a first end of the first portion of the first flexible hinge panel is sandwiched between the front surface of the first portion of the backrest and the rear aspect of the first lateral support and a second end of the first portion of the first flexible hinge panel is sandwiched between the front surface of the first portion of the backrest and the rear aspect of the third lateral support.

20. The towable inflatable device of claim 19 wherein, when the second portion of the backrest is in the first position, a first end of the second portion of the first flexible hinge panel is sandwiched between the front surface of the second portion of the backrest and the rear aspect of the second lateral support and a second end of the second portion of the first flexible hinge panel is sandwiched between the front surface of the second portion of the backrest and the rear aspect of the third lateral support.

* * * * *